US010745221B2

(12) United States Patent
Koyama et al.

(10) Patent No.: US 10,745,221 B2
(45) Date of Patent: Aug. 18, 2020

(54) SHEET SEPARATING DEVICE AND IMAGE FORMING APPARATUS

(71) Applicant: FUJI XEROX CO., LTD., Tokyo (JP)

(72) Inventors: Takaharu Koyama, Kanagawa (JP); Akira Harada, Kanagawa (JP); Mitsuaki Kuroda, Kanagawa (JP); Masahito Shikata, Kanagawa (JP); Yuji Hayakawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/112,802

(22) Filed: Aug. 27, 2018

(65) Prior Publication Data

US 2019/0263608 A1 Aug. 29, 2019

(30) Foreign Application Priority Data

Feb. 28, 2018 (JP) ..... 2018-034501

(51) Int. Cl.

| | |
|---|---|
| ***B65H 3/44*** | (2006.01) |
| ***B65H 1/04*** | (2006.01) |
| ***B65H 11/00*** | (2006.01) |
| ***B65H 1/08*** | (2006.01) |
| ***B65H 5/26*** | (2006.01) |

(52) U.S. Cl.

CPC ..... *B65H 1/08* (2013.01); *B65H 5/26* (2013.01)

(58) Field of Classification Search

CPC ..... B65H 3/44; B65H 2405/332; B65H 2407/21; B65H 2407/11312; B65H 1/04

See application file for complete search history.

(56) References Cited

U.S. PATENT DOCUMENTS

| | | | | |
|---|---|---|---|---|
| 7,063,314 B2 * | 6/2006 | Eskey | ..... | B65H 3/44 271/9.01 |
| 2005/0140078 A1 * | 6/2005 | Fujiwara | ..... | B65H 3/06 271/9.01 |

FOREIGN PATENT DOCUMENTS

| | | | |
|---|---|---|---|
| JP | 63101234 A | * | 5/1988 |
| JP | 63272727 A | * | 11/1988 |
| JP | 03147646 A | * | 6/1991 |
| JP | 04358634 A | * | 12/1992 |
| JP | 05265278 A | * | 10/1993 |
| JP | 2001002314 A | * | 1/2001 |
| JP | 2002338070 A | * | 11/2002 |
| JP | 2015098404 | | 5/2015 |
| JP | 2015110484 | | 6/2015 |

* cited by examiner

*Primary Examiner* — Luis A Gonzalez
(74) *Attorney, Agent, or Firm* — JCIPRNET

(57) ABSTRACT

A sheet separating device includes a sheet separator that includes plural separating portions which have a planar shape and which are stacked one on top of another. The sheet separator has openings provided between the plural separating portions at both ends of the plural separating portions in a sheet passing direction. The sheet separator allows gaps between the plural separating portions facing one another to receive one of plural sheets apiece so as to cause the plural sheets to be kept separated from one another. The sheet separating device is held on a placement portion of a sheet processing apparatus that includes a sheet processing unit and the placement portion. The sheet processing unit sequentially feeds thereinto the plural sheets through a feeding opening and performs processing on the plural sheets. The plural sheets to be fed through the feeding opening are placed on the placement portion.

11 Claims, 13 Drawing Sheets

SHEET SEPARATING DEVICE AND IMAGE FORMING APPARATUS

CROSS-REFERENCE TO RELATED APPLICATIONS

This application is based on and claims priority under 35 USC 119 from Japanese Patent Application No. 2018-034501 filed Feb. 28, 2018.

BACKGROUND

(i) Technical Field

The present invention relates to a sheet separating device and an image forming apparatus.

(ii) Related Art

When plural sheets of paper are stacked one on top of another and placed on a manual feed tray, multifeed in which the sheets that remain stacked are fed without being separated from one another may occur. In the case of long sheets, particularly in the case of long sheets having a smooth surface such as coated sheets, the likelihood of the occurrences of the multifeed increases.

SUMMARY

According to an aspect of the present invention, a sheet separating device includes a sheet separator that includes plural separating portions which have a planar shape and which are stacked one on top of another. The sheet separator has openings provided between the plural separating portions at both ends of the plural separating portions in a sheet passing direction. The sheet separator allows gaps between the plural separating portions facing one another to receive one of plural sheets apiece so as to cause the plural sheets to be kept separated from one another. The sheet separating device is held on a placement portion of a sheet processing apparatus that includes a sheet processing unit and the placement portion. The sheet processing unit sequentially feeds thereinto the plural sheets through a feeding opening and performs processing on the plural sheets. The plural sheets to be fed through the feeding opening are placed on the placement portion.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below.

In the following, problems that may arise when a long sheet is placed on a manual feed tray of a multi-function machine so as to feed the long sheet into the multi-function machine are described first, and after that, exemplary embodiments of the present invention are described.

Figure 1:
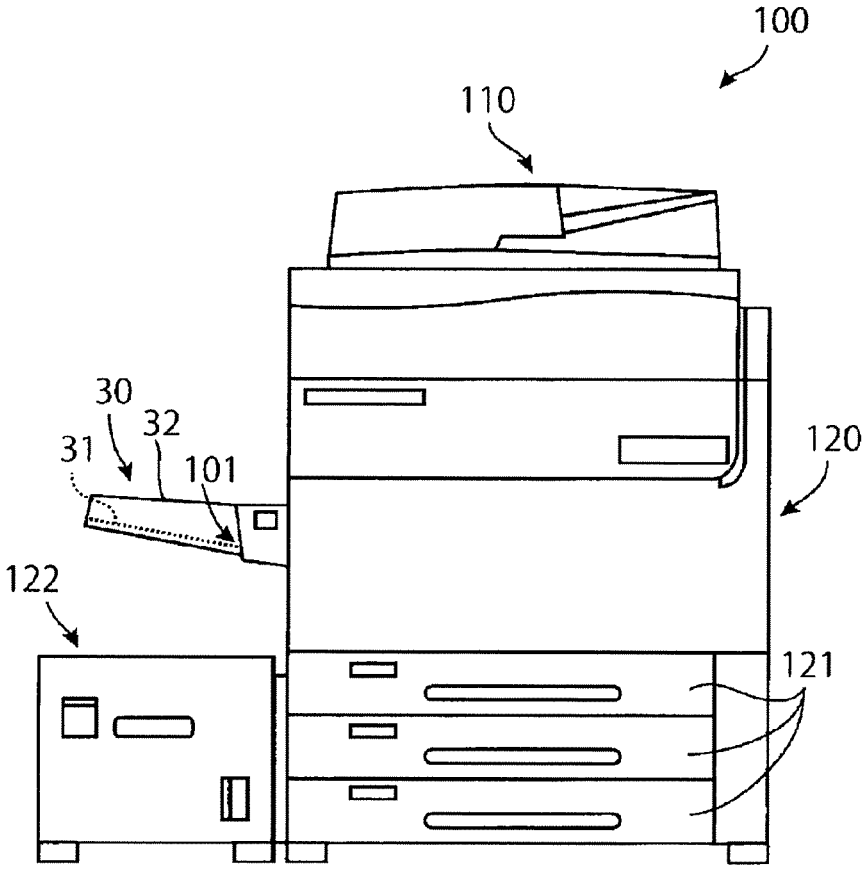
FIG. 1 is a schematic view of a multi-function machine.

FIG. 1 is a schematic view of the multi-function machine.

This multi-function machine 100 includes a scanner 110 disposed in its upper portion. The scanner 110 reads images on a document so as to generate image data. The multi-function machine 100 also includes a printer 120 disposed below the scanner 110. The printer 120 forms images on sheets of paper. Furthermore, the multi-function machine 100 includes three sheet trays 121 disposed below the printer 121. The sheet trays 121 contain sheets of paper on which images have not yet been formed. Each of the sheet trays 121 is able to be drawn out. The sheet trays 121 are drawn out from the multi-function machine 100A when receiving sheets of paper. Furthermore, the multi-function machine 100 includes a sheet container box 122. The sheet container box 122 is separately provided at a position adjacent to the sheet trays 121. The sheet container box 122, which has the same function as that of the sheet trays 121, contains a size of sheets that are used in large quantities. In order to form images on the sheets of paper, the sheets are fed one sheet after another from the sheets in one of the three sheet trays 121 or the sheet container box 122 into the printer 120. The images are formed on the sheets fed into the printer 120. The images formed by the printer 120 may be based on image data obtained by reading the document with the scanner 110 or image data transmitted from a personal computer or the like (not illustrated).

Furthermore, the multi-function machine 100 includes a manual feed tray 30. The manual feed tray 30 is used for forming images on non-standard size sheets or types of standard-size sheets not contained in the sheet trays 121 or the sheet container box 122. The manual feed tray 30 includes a placement plate 31 and guide plates 32. The sheets are placed on the placement plate 31. The guide plates 32 stand erect on respective sides of the placement plate 31 so as to support the sheets placed on the placement plate 31 from both sides.

Stacked plural sheets are able to be placed on the placement plate 31 of the manual feed tray 30. The sheets placed on the placement plate 31 are fed one sheet after another through a feeding opening 101 into the multi-function machine 100, and images are formed on the sheets having fed into the multi-function machine 100 by the printer 120.

Here, it is assumed that an image is formed on long sheets having a length of, for example, 1200 mm by using the multi-function machine 100. Such long sheets, which are not able to be loaded in the sheet trays 121 or the sheet container box 122, are fed into the multi-function machine 100 by being placed on the manual feed tray 30.

Figure 2:
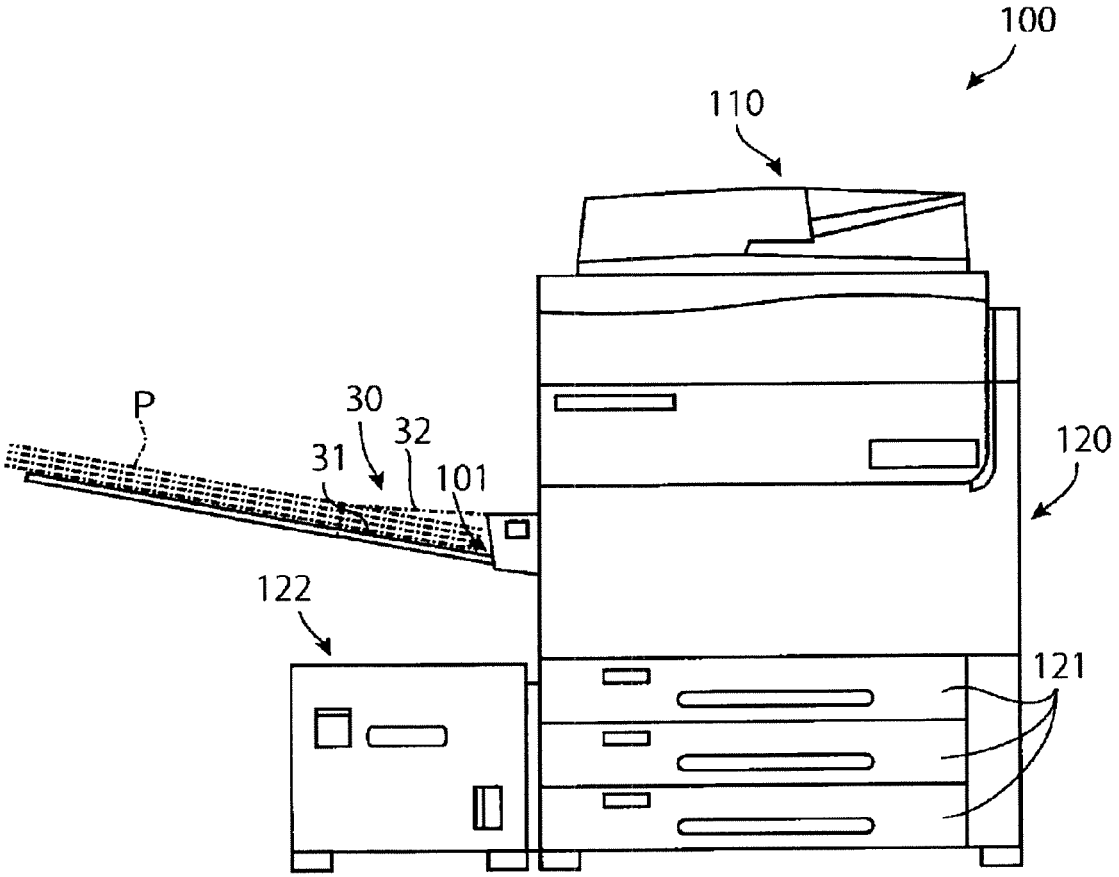
FIG. 2 illustrates the multi-function machine when long sheets are placed on a manual feed tray.

FIG. 2 illustrates the multi-function machine when the long sheets are placed on the manual feed tray.

Plural long sheets P stacked one on top of another and placed on the placement plate 31 of the manual feed tray 30 are illustrated in FIG. 2. It is noted that, in FIG. 2 and after, the guide plates 32 of the manual feed tray 30 are drawn by an imaginary line (one-dot chain line) so as to illustrate a state behind the guide plates 32.

In some cases, the placement plate 31 of the manual feed tray 30 is extendable so as to correspond to sheets of large sizes as long as these sizes are standard sizes. Accordingly, it is thought that, as illustrated in FIG. 2, the placement plate 31 is made to be extendable to such a degree that the long sheets are able to be placed on the placement plate 31. Alternatively, even when it is impossible to extend the placement plate 31 to the length of the long sheets, it is thought that another long plate is placed on and secured to the placement plate 31 so as to allow the long sheets to be placed on the long plate.

However, a contact area between the long sheets, particularly between long sheets having smooth surfaces such as coated sheets, where the long sheets are in contact with one another is larger than the contact area between normal size sheets. Accordingly, a frictional force generated between the long sheets when each of the long sheets is fed into the multi-function machine 100 is large. Thus, so-called multi-feed in which plural long sheets fed into the multi-function machine 100 are not separated from one another and are remain stacked is likely to occur with the long sheets.

Furthermore, the positioning of the long sheets placed on the placement plate 31 in the width direction is performed only at leading end portions of the long sheets P near the multi-function machine 100. In this mechanism for the positioning in the width direction, there is a small degree of play which does not arise a problem when feeding normal size sheets. However, in the case of the long sheets P, when the long sheets P are fed into the multi-function machine 100 even with slight inclination at the leading end portions, trailing end portions of the long sheets P are largely deviated in the width direction and not necessarily correctly fed into the multi-function machine 100.

Furthermore, as understood from FIG. 2, when the placement plate 31 extendable to such a degree that the long sheets P are able to be placed thereon is provided or the long plate on which the long sheets P are able to be placed is secured to the placement plate 31, a large space is required to place the long sheets P. This may be inconvenient.

In exemplary embodiments described below, a sheet separating device has a structure with which multifeed may be able to be suppressed even when the long sheets P, particularly long sheets having smooth surfaces such as coated sheets, are used. Also in the following, among the exemplary embodiments to be described, some exemplary embodiments have a structure that may suppress inclination of sheets in the width direction or a structure with which space reduction may be achieved.

Figure 3:
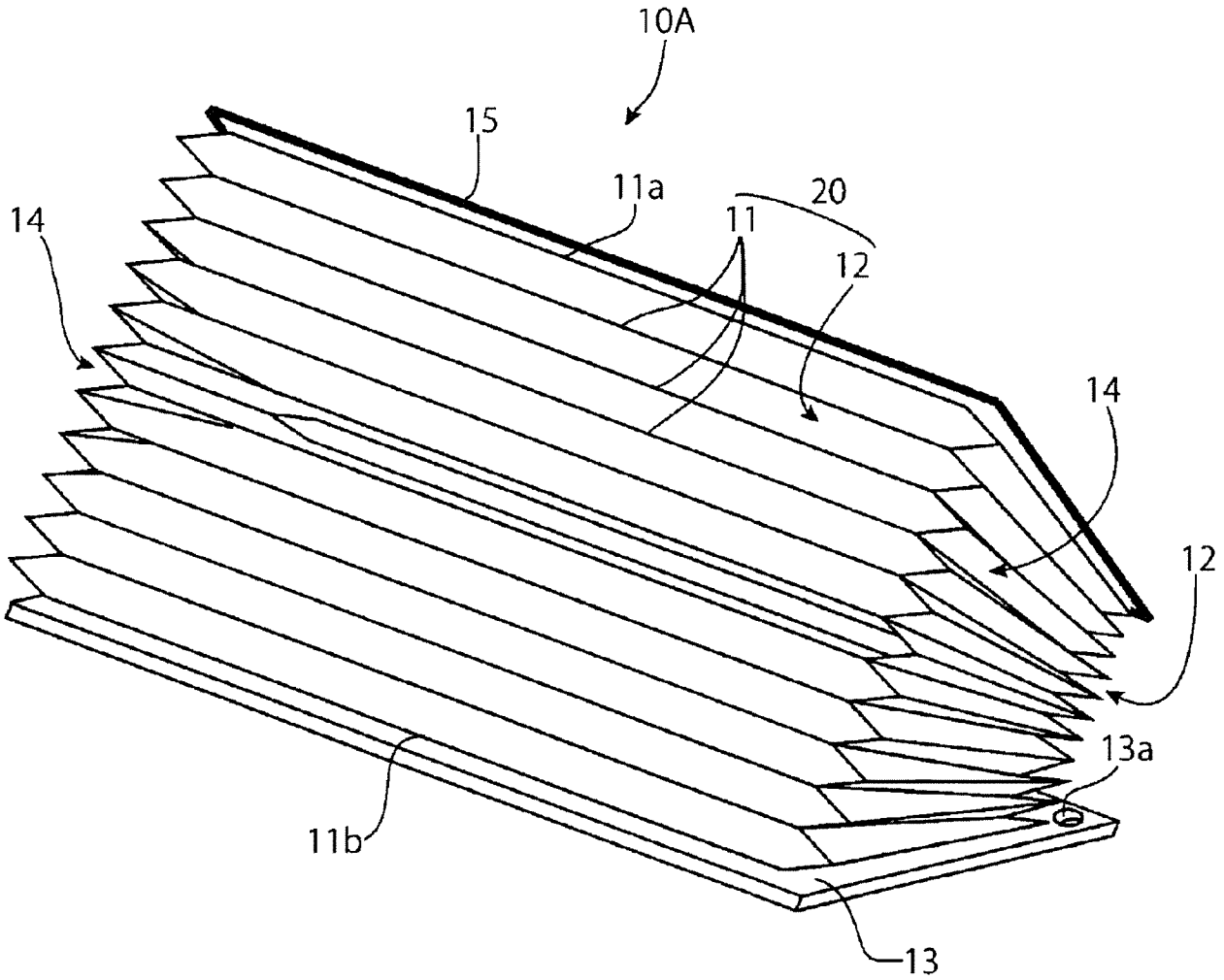
FIG. 3 is a schematic view of a sheet separating device according to a first exemplary embodiment of the present invention.

FIG. 3 is a schematic view of a sheet separating device according to a first exemplary embodiment of the present invention. It is noted that connecting arms 16 (see FIGS. 4 and 5) included in a sheet separating device 10A are omitted from FIG. 3.

Figure 4:
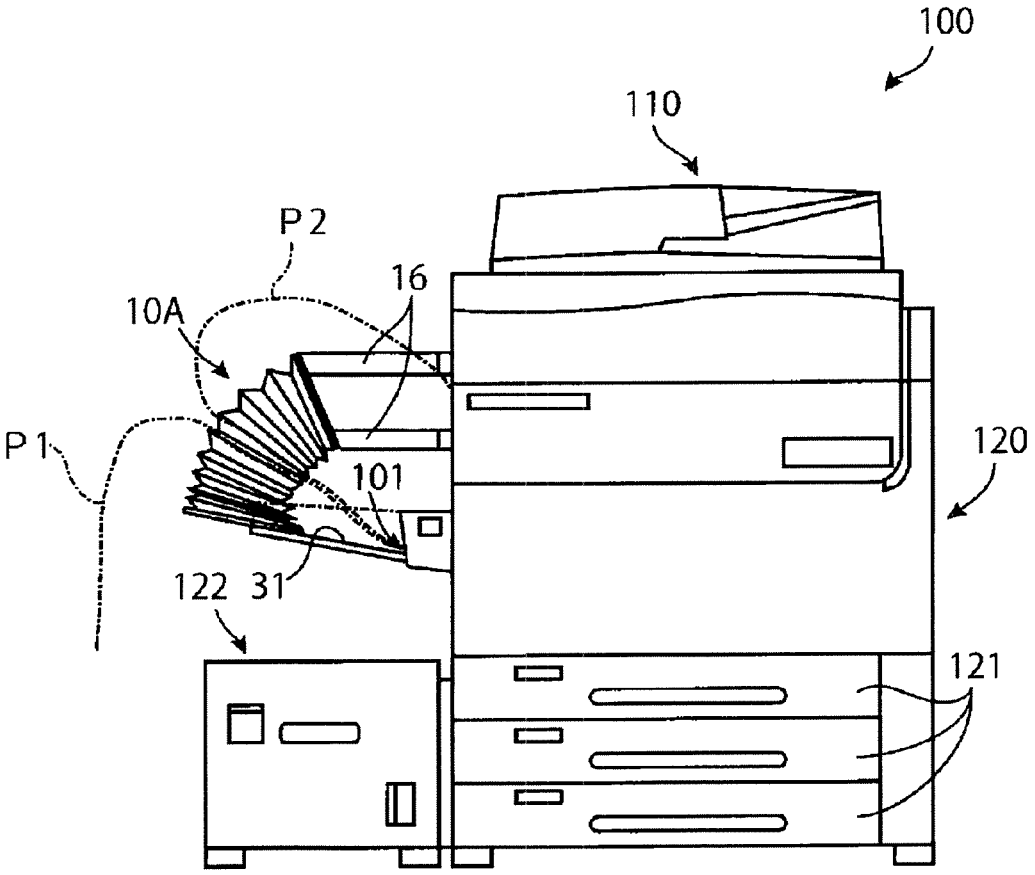
FIG. 4 is a front view of the multi-function machine on which the sheet separating device illustrated in FIG. 3 is held.
Figure 5:
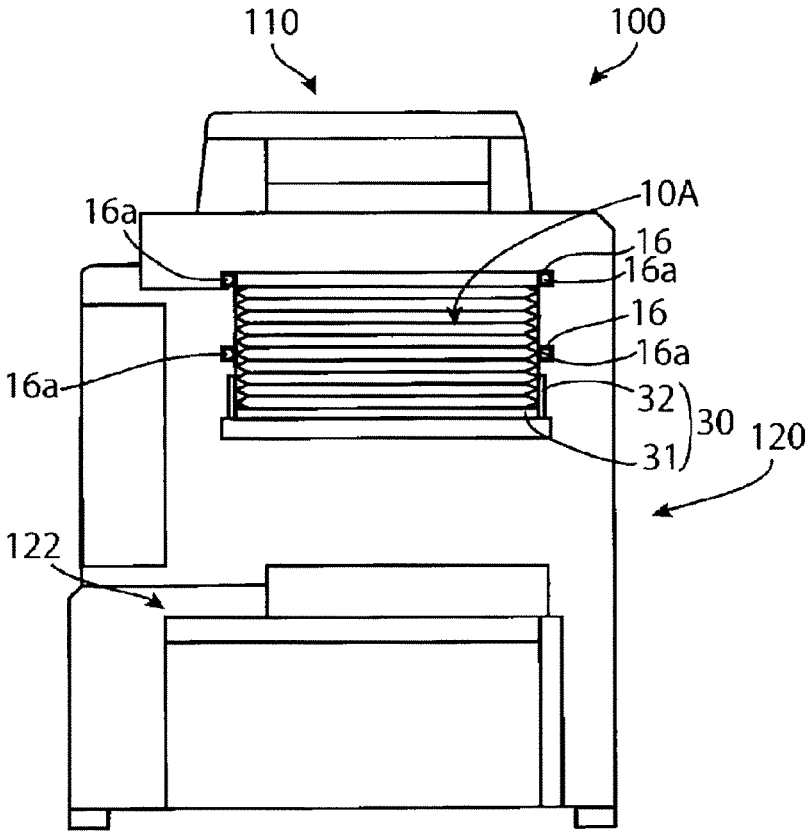
FIG. 5 is a side view, when seen from the manual feed tray side, of the multi-function machine on the sheet separating device illustrated in FIG. 3 is held.

Furthermore, FIGS. 4 and 5 are schematic views of the multi-function machine on which the sheet separating device illustrated in FIG. 3 is held. Here, FIG. 4 is a front view of the multi-function machine. FIG. 5 is a side view of the multi-function machine when seen from the manual feed tray side.

As illustrated in FIG. 3, the sheet separating device 10A includes a sheet separator 20 that includes separating plates 11 and openings 12. The plural separating plates 11, which each extend in a planar shape, are stacked. Furthermore, the openings 12 are provided between the separating plates 11 at both ends (front surfaces facing upper left in FIG. 2 and rear surfaces of the front surfaces) of the separating plates 11 in a sheet passing direction. With the separating plates 11 and the openings 12, the sheet separator 20 is configured in which gaps between the separating plates 11 facing one another receive one of the plural sheets apiece so that the plural sheets are kept separated from one another. Here, the separating plates 11 and the openings 12 according to the first exemplary embodiment respectively correspond to examples of separating portions and examples of openings described in the present invention. However, an uppermost separating plate 11*a* is affixed to an upper plate 15 at an uppermost position, and a combination of the uppermost separating plate 11 and the upper plate 15 is regarded as an example of an uppermost separating portion.

The sheet separating device 10A also includes a holding plate 13. A lowermost separating plate 11 is affixed to the holding plate 13. The holding plate 13, which is mounted on the manual feed tray 30 of the multi-function machine 100, is used for a structure in which the manual feed tray 30 holds the sheet separating device 10A. Specifically, according to the first exemplary embodiment, the holding plate 13 has screw holes 13*a* and is secured to the placement plate 31 of the manual feed tray 30 of the multi-function machine 100 with screws. The holding plate 13 corresponds to an example of a holding portion described in the present invention.

Furthermore, the sheet separating device 10A according to the first exemplary embodiment includes coupling portions 14 between the separating plates 11 on both sides of the separating plates 11 in the sheet width direction intersecting the sheet passing direction. These coupling portions 14 on both sides connect the separating plates 11 to one another in the up-down direction, that is, in a stacking direction in which the separating plates 11 are stacked. Here, the coupling portions 14 according to the first exemplary embodiment have a bellows shape and connect the separating plates 11 such that a closed state in which the separating plates 11 are in contact with one another and an open state in which the separating plates 11 adjacent to each other are spaced from each other are switchable to each other.

The separating plates 11 are formed of a flexible material such as, for example, a polyethylene terephthalate (PET) film. More specifically, according to the first exemplary embodiment, the separating plates 11 and the coupling portions 14 are formed by stacking in the stacking direction plural bag-shaped members formed of a flexible material such as, for example, a PET film. Each of the bag-shaped members is open at both ends in the sheet passing direction, and the bag-shaped members adjacent to each other are bonded or fused to each other. It is noted that, according to the first exemplary embodiment, the flexibility of a lowermost separating plate 11*b*, which is secured to the holding plate 13 by bonding or the like, is lost. Also according to the first exemplary embodiment, the upper plate 15 having low flexibility is disposed at the uppermost position. In the closed state in which the separating plates 11 adjacent to each other are closed, this upper plate 15 at the uppermost position functions as, together with the placement plate 31 of the manual feed tray 30, a table on which the sheets are placed. For this reason, the upper plate 15 is formed of a plate the material of which allows the sheets suitably slide thereon.

As illustrated in FIGS. 4 and 5, the sheet separating device 10A according to the first exemplary embodiment also includes the connecting arms 16. One end of each of the connecting arms 16 is secured to the upper plate 15 and the other end of the connecting arm 16 is secured to the multi-function machine 100. According to the first exemplary embodiment, the connecting arms 16 are secured to the multi-function machine 100 with screws by using screw holes 16*a* provided in the connecting arms 16. When the upper plate 15 of the sheet separating device 10A is connected to the multi-function machine 100 by the connecting arms 16 by securing the connecting arms 16 to the multi-function machine 100 with the screws, the sheet separating device 10A is maintained in the open state in which the separating plates 11 are spaced from one another as illustrated in FIGS. 4 and 5. The connecting arms 16 each correspond to an example of a connecting portion described in the present invention.

The gaps between the separating plates 11 adjacent to one another receive one sheet apiece in the sheet separating device 10A which is maintained in the open state by using the connecting arms 16. The received sheets are disposed such that the leading ends thereof face the feeding opening 101.

In FIG. 4, two long sheets P1, P2 are illustrated as examples. According to the first exemplary embodiment, a structure that regulates the positions of trailing end portions of long sheets P1, P2 inserted into the sheet separating device 10A are not particularly provided. Thus, the trailing ends of the long sheets P remain hanging down similarly to, for example, the long sheet P1. In this case, the long sheet P1 may move and drop from the portion of the sheet separating device 10A opposite to the multi-function machine 100. Thus, the user may be required to support the long sheet P1 in some cases. Alternatively, as is the case with the long sheet P2, the trailing end portions may be supported by the multi-function machine 100 when the long sheets P have a length with which the trailing end portions are appropriately supported. An exemplary embodiment having a structure that regulates the position of the trailing end portions of the sheets will be described later.

Figure 6:
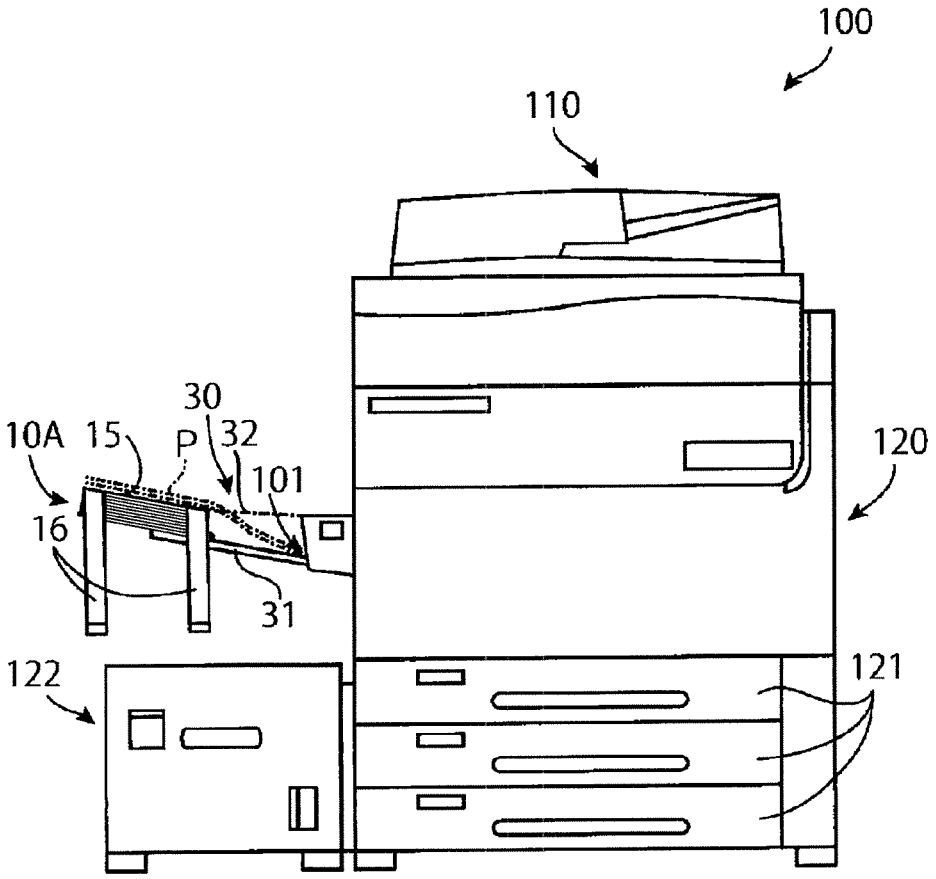
FIG. 6 is a schematic view of the sheet separating device in the closed state while the sheet separating device is still held on the manual feed tray of the multi-function machine.

FIG. 6 is a schematic view of the sheet separating device in the closed state while the sheet separating device is held on the manual feed tray of the multi-function machine.

According to the present exemplary embodiment, the connecting arms 16 are not particularly removed and remain hanging down. However, since the connecting arms 16 are not used in the closed state as illustrated in FIG. 6, a structure with which the connecting arms 16 are easily mounted and removed may be used.

Referring to FIG. 6, normal standard size sheets P are placed so as to exist on both the placement plate 31 of the manual feed tray 30 and an upper surface (upper plate 15) of the sheet separating device 10A in the closed state. Thus, the upper surface (upper plate 15) of the sheet separating device 10A in the closed state is made to be, together with the placement plate 31, usable as a table on which the sheets are placed. This allows the sheet separating device 10A to remain secured to the manual feed tray 30 even when the sheet separating device 10A is not in use. This may increase convenience in handling of the sheet separating device 10A.

Figure 7:
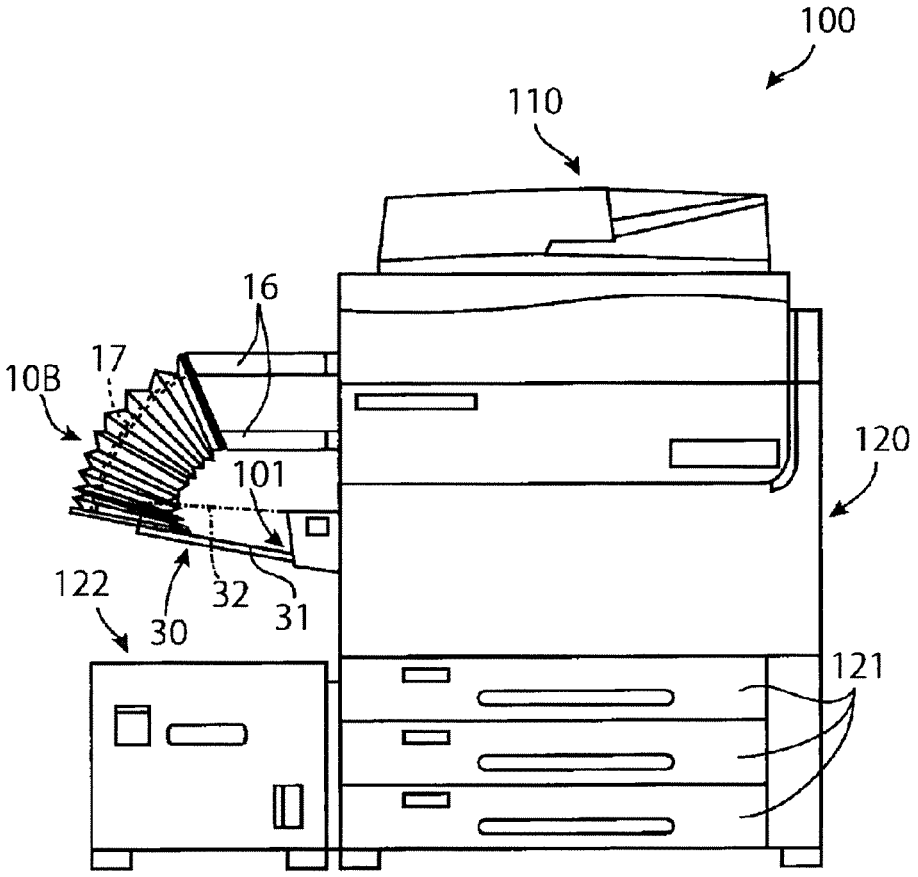
FIG. 7 is a schematic view of the multi-function machine on which a sheet separating device according to a second exemplary embodiment of the present invention is held.

FIG. 7 is a schematic view of the multi-function machine on which a sheet separating device according to a second exemplary embodiment of the present invention is held.

In description of the second exemplary embodiment, elements corresponding to the elements of the first exemplary embodiment are denoted by the same reference signs as those of the first exemplary embodiment, and features different from those of the first exemplary embodiment are described.

A sheet separating device 10B according to the second exemplary embodiment illustrated in FIG. 7 further includes sheet regulating sticks 17 in addition to the elements of the sheet separating device 10A according to the first exemplary embodiment. The sheet regulating sticks 17 are rod-shaped members inserted into the separating plates 11 (see FIG. 3) in the stacking direction so as to regulate the position of the sheets in the width direction.

Figure 8A:
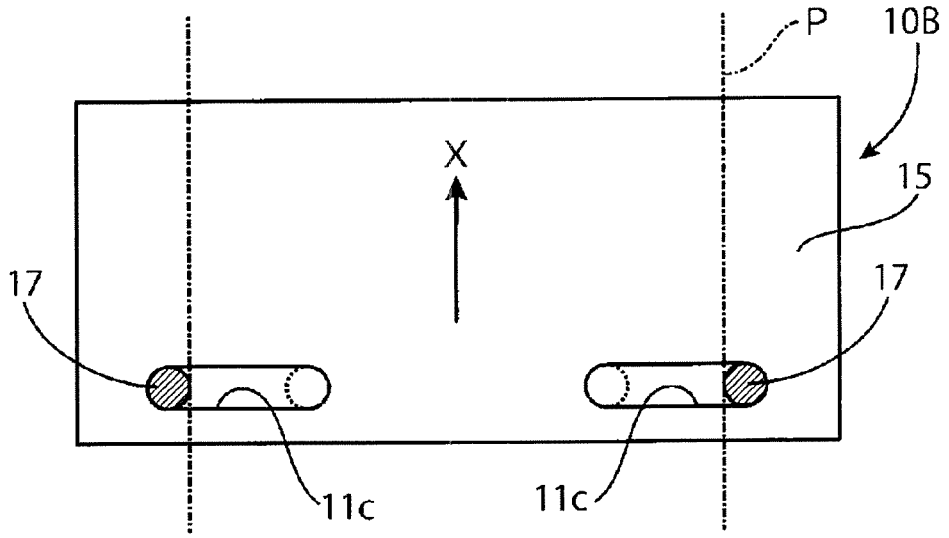
FIGS. 8A and 8B are plan views of the sheet separating device with the sheet regulating sticks when seen in the stacking direction of the separating plates.
Figure 8B:
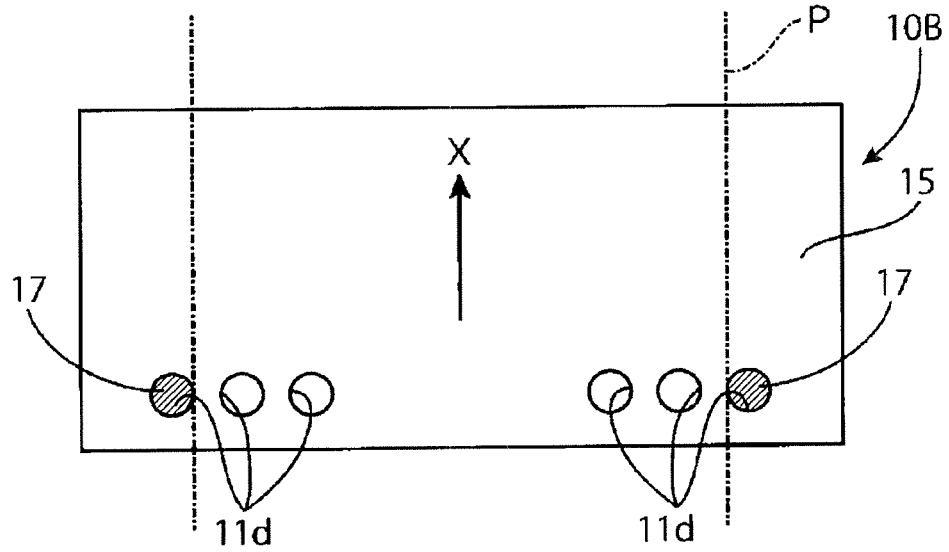

FIGS. 8A and 8B are plan views of the sheet separating device with the sheet regulating sticks when seen in the stacking direction of the separating plates.

As illustrated in FIG. 8A, the sheet separating device 10B has long holes 11*c* elongated in the width direction on both sides in the width direction. The sheet regulating sticks 17 are inserted into these long holes 11*c* that penetrate through the separating plates 11 (see FIG. 3). In FIG. 8A, the sheet regulating sticks 17 are inserted at positions corresponding to the sheets P having a maximum width. However, when sheets having a smaller width than the sheets P are used, the sheet regulating sticks 17 are slid to positions corresponding to the width of the sheets of the smaller width. Each of the sheets P is disposed in the gap between the separating plates 11 adjacent to each other such that both sides of the sheet P in the width direction are interposed between the sheet regulating sticks 17.

Here, as illustrated in FIG. 7, when the sheet separating device 10B is in the open state, the sheet regulating sticks 17 are curved in an arc shape. Accordingly, the sheet regulating sticks 17 may extend in an arc shape following an arc shape of a direction of the long holes 11*c* penetrating through the separating plates 11 in the open state. In this case, the sheet regulating sticks 17 may be inserted into the long holes 11*c* when the sheet separating device 10B is in the open state. Alternatively, the sheet regulating sticks 17 may be flexible members similar to so-called flexible curve rulers. Alternatively, the sheet regulating sticks 17 themselves may be straightly extending rods. In this case, the width of the long holes 11*c* may be increased in the sheet transport direction indicated by an arrow X so as to correspond to both the closed and open states.

When the sheet regulating sticks 17 are provided so as to regulate the position of the sheets P in the width direction, compared to the sheet separating device that does not include the sheet regulating sticks 17, skew of the sheets P occurring when the sheets P are fed into the multi-function machine 100 through the feeding opening 101 may be suppressed. Here, the sheet regulating sticks 17 each correspond to an example of a sheet regulating portion described in the present invention.

FIG. 8B illustrates a variation of the sheet separating device 10B illustrated in FIG. 8A. In this variation, three holes 11*d* are arranged on each of the left and right sides of each of the separating plates 11. These holes 11*d* penetrate through the separating plates 11. The sheet regulating sticks 17 are inserted into the holes 11*d*. The distances between the holes 11*d* on the left side and the corresponding holes 11*d* on the right side correspond to three standard sheet widths.

As illustrated in FIG. 8B, in each of the separating plate 11, plural holes 11*d* may be provided for insertion of each of the sheet regulating sticks 17.

Figure 9:
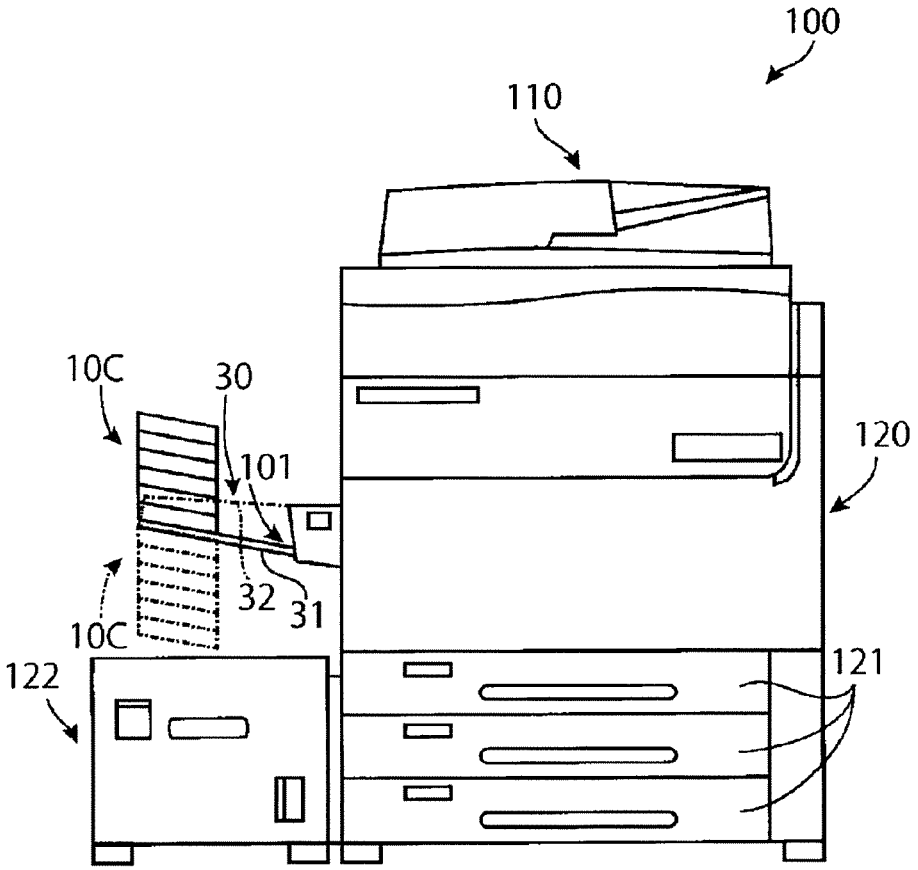
FIG. 9 is a structural view of the multi-function machine on which a sheet separating device according to a third exemplary embodiment of the present invention is held.

FIG. 9 is a structural view of the multi-function machine on which a sheet separating device according to a third exemplary embodiment of the present invention is held.

Figures 10A, 10B:
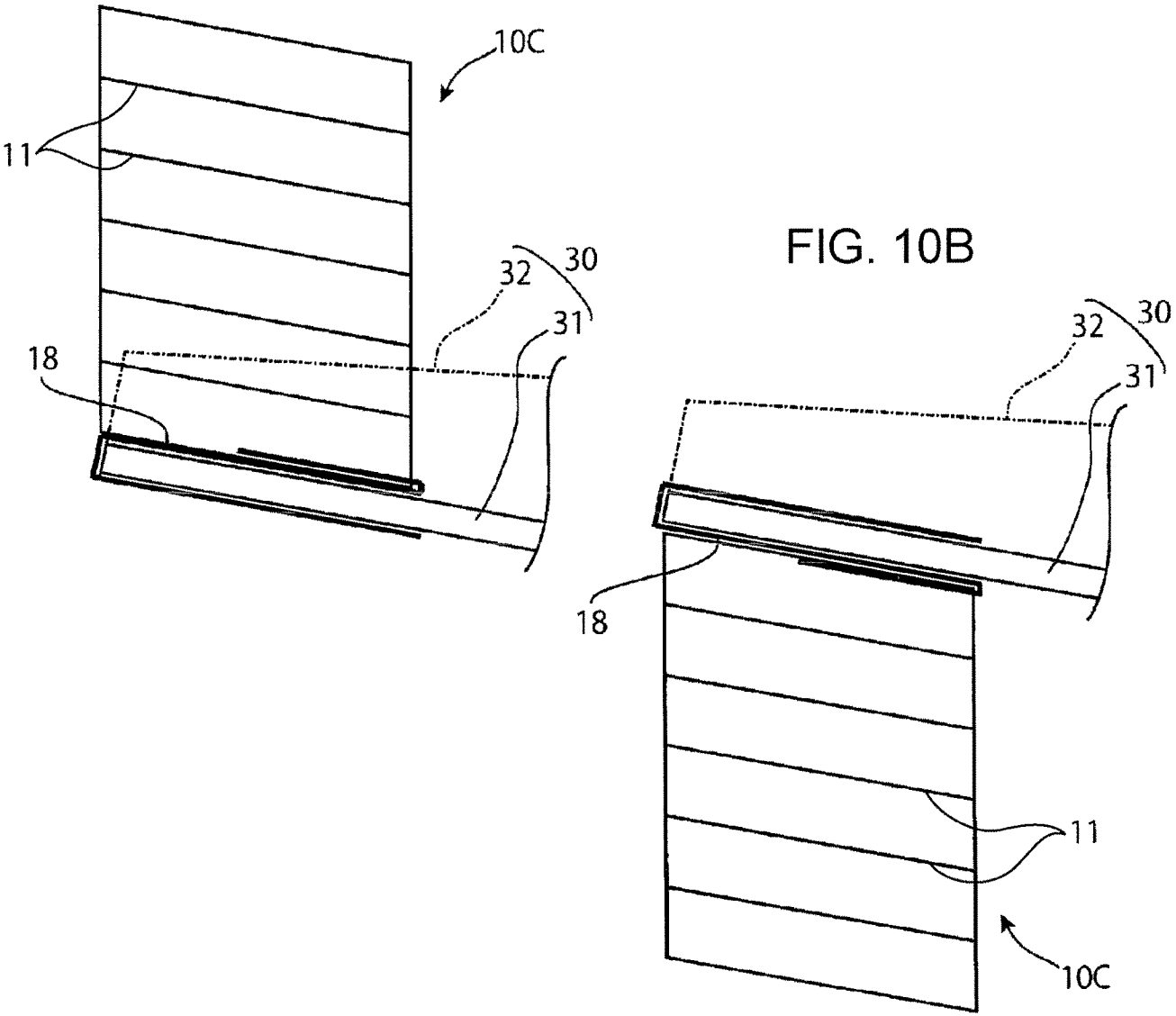
FIGS. 10A and 10B are schematic views of the sheet separating device according to the third exemplary embodiment illustrated in FIG. 9, zooming in the sheet separating device compared to FIG. 9.

Furthermore, FIGS. 10A and 10B are schematic views of the sheet separating device according to the third exemplary embodiment illustrated in FIG. 9, zooming in the sheet separating device compared to FIG. 9.

A sheet separating device 100 is non-flexible and not provided with the closed state. The sheet separating device 100 is fixed in the open state in which the gaps are formed between the separating plates 11 adjacent to each other. A support member 18 is mounted on the sheet separating device 100. The support member 18 has an opening extending in the sheet transport direction so that the support member 18 has a U shape. When the support member 18 is fitted onto the placement plate 31 of the manual feed tray 30, the sheet separating device 100 is held on the placement plate 31. As illustrated in FIG. 10A, the support member 18 of the sheet separating device 100 is able to be fitted onto the placement plate 31 while the sheet separating device 100 is assuming a position in which the sheet separating device 10C is disposed on the upper side of the placement plate 31. Furthermore, as illustrated in FIG. 10B, the support member 18 in an inverted position is also able to be fitted onto the placement plate 31. Thus, when the sheet separating device 100 is used, the sheet separating device 100 is disposed on the upper side of the placement plate 31 as illustrated in FIG. 10A, and when the sheet separating device 100 is not used, the sheet separating device 100 is supported by the placement plate 31 so that the sheet separating device 100 is disposed on the lower side of the placement plate 31 as illustrated in FIG. 10B.

With the sheet separating device 100 according to the third exemplary embodiment, compared to the sheet separating device to be secured only to the upper side of the placement plate 31, for example, a storing location of the sheet separating device not in use may be easily obtained.

The support member 18 of the sheet separating device 100 according to the third exemplary embodiment, which has a function of holding the sheet separating device 100 on the manual feed tray 30, corresponds to an example of the holding portion described in the present invention. Furthermore, the support member 18, which supports the sheet separating device 100 on the upper and lower side of the manual feed tray 30 such that the sheet separating device 100 is able to be moved from the lower to upper side of the manual feed tray 30 or vice versa, corresponds to an example of a support portion described in the present invention.

Figure 11:
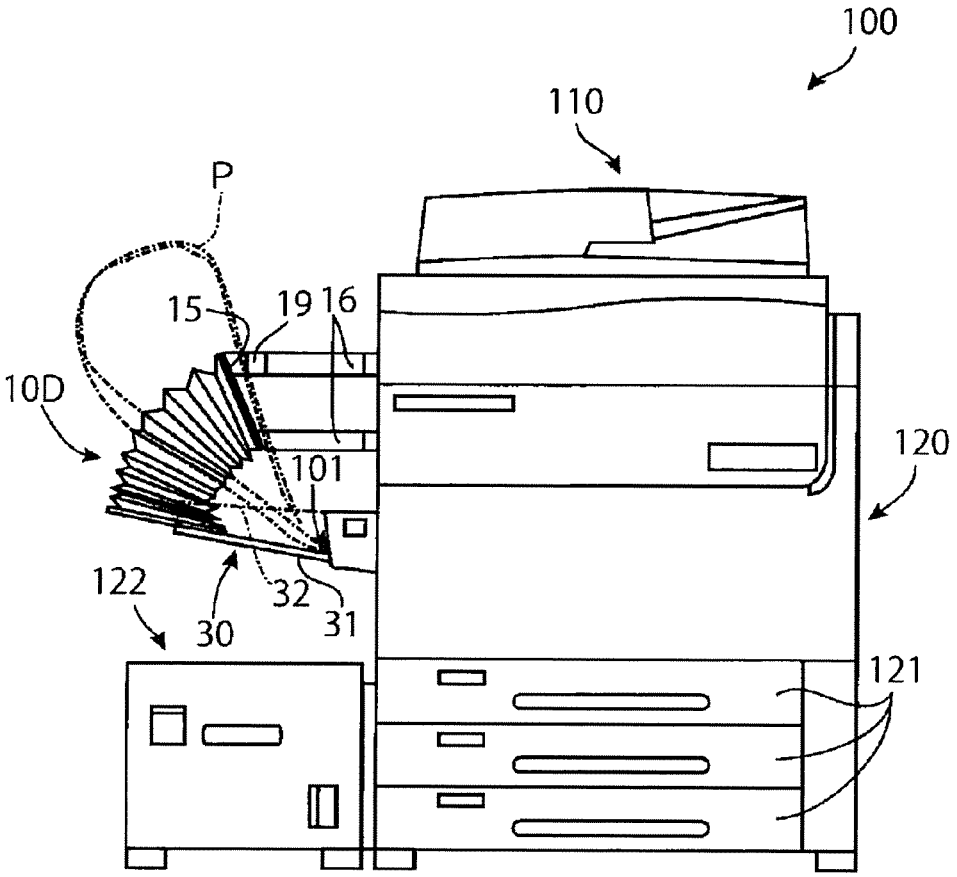
FIG. 11 is a schematic view of the multi-function machine on which a sheet separating device according to a fourth exemplary embodiment of the present invention is held.

FIG. 11 is a schematic view of the multi-function machine on which a sheet separating device according to a fourth exemplary embodiment of the present invention is held.

Figure 12:
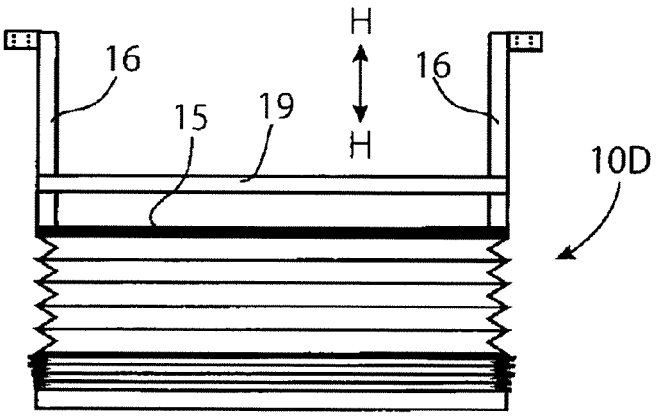
FIG. 12 is a plan view, seen from above, of the sheet separating device according to the fourth exemplary embodiment illustrated in FIG. 11 held on the multi-function machine as illustrated in FIG. 11.

Furthermore, FIG. 12 is a plan view, seen from above, of the sheet separating device according to the fourth exemplary embodiment illustrated in FIG. 11 held on the multi-function machine as illustrated in FIG. 11.

A sheet separating device 10D according to the fourth exemplary embodiment further includes a sheet holding bar 19 in addition to the elements of the sheet separating device 10A (see, for example, FIG. 4) according to the first exemplary embodiment. As illustrated in FIG. 12, the sheet holding bar 19 extends in the width direction, is supported by the connecting arms 16 on the left and right, and is slidable in an arrow H-H direction.

In order to feed the long sheets P through the feeding opening 101 adjacent to the manual feed tray 30 into the multi-function machine 100, the gaps between the separating plates 11 adjacent to one another receive one of the long sheets P apiece, and the leading ends of the long sheets P face the feeding opening 101. The trailing ends of plural long sheets P are collectively folded and held in a state in which the trailing ends of the long sheets P are interposed between the upper plate 15 and the sheet holding bar 19 as illustrated in FIG. 11. This may reduce a space for disposition of the long sheets P.

The sheet holding bar 19 corresponds to an example of a sheet holding portion described in the present invention.

Figure 13:
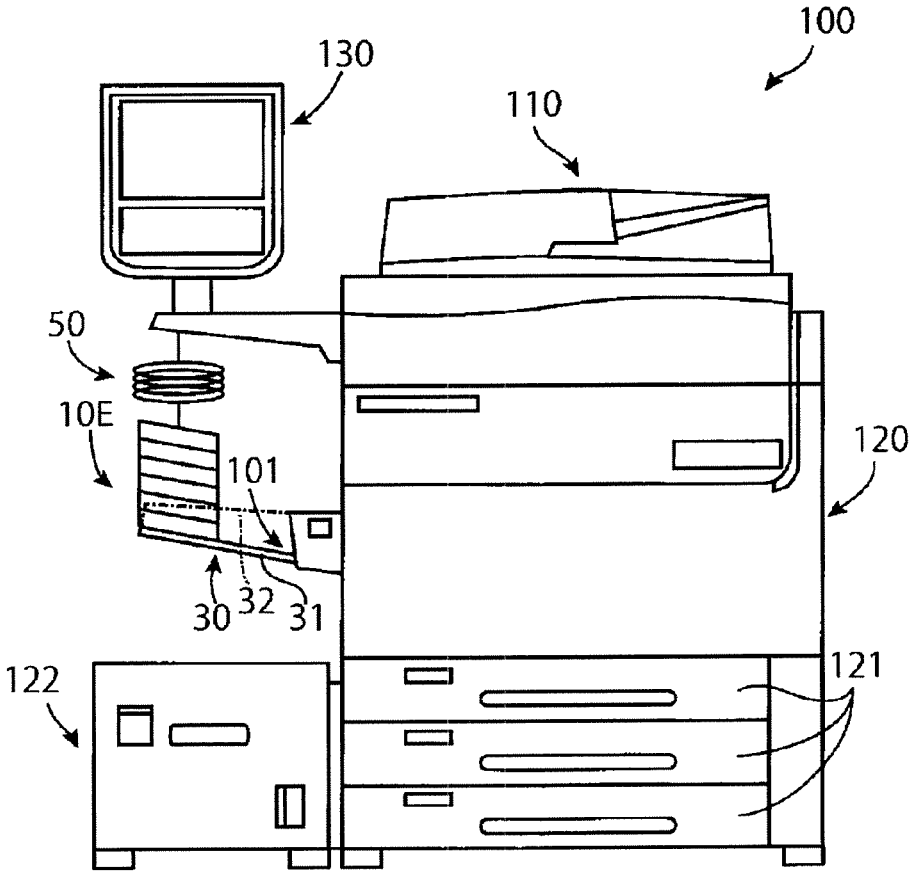
FIG. 13 is a schematic view of the multi-function machine on which a sheet separating device according to a fifth exemplary embodiment of the present invention is held.
Figure 14:
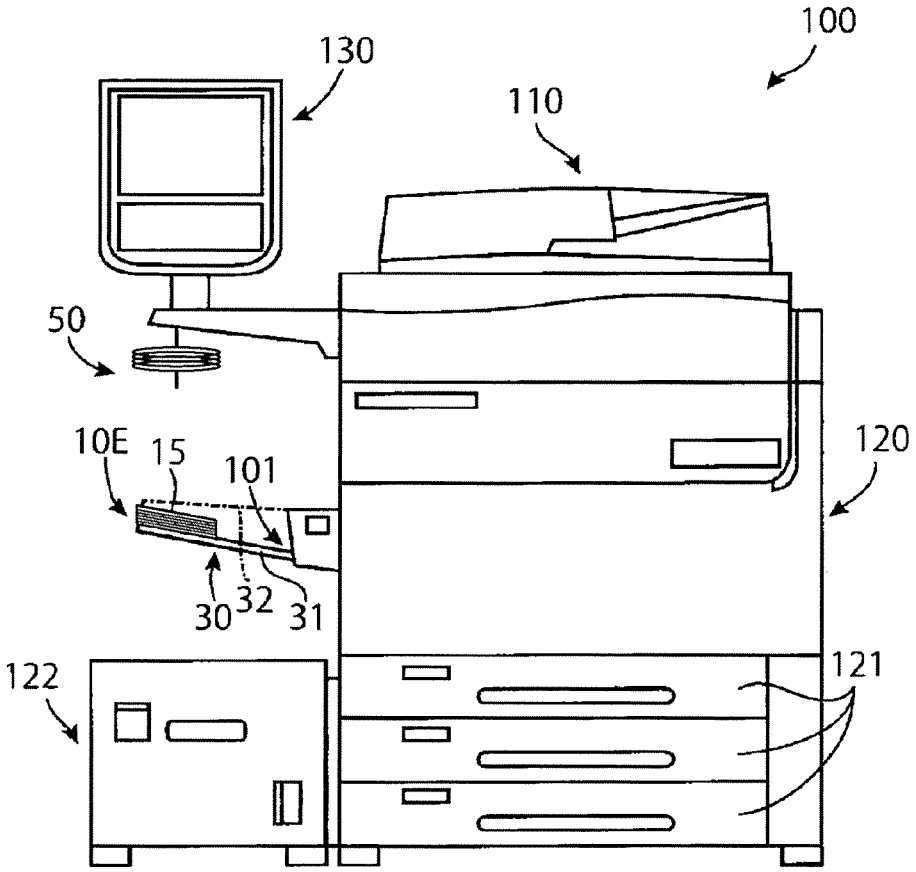
FIG. 14 is a schematic view of the multi-function machine on which the sheet separating device according to the fifth exemplary embodiment of the present invention is held.

FIGS. 13 and 14 are schematic views of the multi function machine on which a sheet separating device according to a fifth exemplary embodiment of the present invention is held. The multi-function machine 100 illustrated in FIGS. 13 and 14 further includes, in addition to the elements of the multi-function machine 100 illustrated in, for example, FIG. 1, a large user interface (UI) 130 disposed above the manual feed tray 30. Here, a sheet separating device 10E is provided with the open state and the closed state. FIG. 13 illustrates the sheet separating device 10E in the open state, and FIG. 14 illustrates the sheet separating device 10E in the closed state.

As illustrated in FIG. 13, the sheet separating device 10E according to the fifth exemplary embodiment is hung from above by using a hanging device 50, thereby the sheet separating device 10E is maintained in the open state. The hanging device 50 is able to be disconnected from the sheet separating device 10E. When the hanging device 50 is disconnected from the sheet separating device 10E, the sheet separating device 10E assumes the closed state while being placed on the placement plate 31 of the manual feed tray 30 as illustrated in FIG. 14. Furthermore, the hanging device 50 has an elastic property. Thus, when the hanging device 50 is disconnected from the sheet separating device 10E, the hanging device 50 is contracted upward. The hanging device 50, which has a function of maintaining the open state in which the separating plates 11 are spaced from one another, corresponds to an example of the connecting portion described in the present invention.

The upper surface 15 of the sheet separating device 10E in the closed state illustrated in FIG. 14 is, together with the placement plate 31 of the manual feed tray 30, used as a table on which the sheets are placed.

When the sheet separating device according to any of the above-described exemplary embodiments is used, compared to the case where plural sheets are stacked and placed on the placement plate 31 of the manual feed tray 30, the occurrences of the multifeed may be suppressed.

Here, as the examples of the holding portion described in the present invention, the holding plate 13 illustrated in FIG. 3 and the support member 18 illustrated in FIGS. 10A and 10B are described. The holding plate 13 is secured to the placement plate 31 with the screws. The support member 18 has the opening so that the support member 18 has the U shape and is fitted onto the placement plate 31. However, the holding portion described in the present invention is not limited to these. It is sufficient that the holding portion hold the sheet separating device on a placement portion such as the placement plate 31.

Furthermore, as the example of the connecting portion described in the present invention, the connecting arms 16 (see, for example, FIG. 4) and the hanging device 50 (see, for example, FIG. 13) are described here. However, the connecting portion described in the present invention is not limited to these. It is sufficient that the connecting portion connect the uppermost separating portion (upper plate 15) and the sheet processing apparatus (multi-function machine 100) to each other so as to maintain the open state in which the separating portions (separating plates 11) adjacent to each other are spaced from each other.

Furthermore, the sheet separating device according to the exemplary embodiments of the present invention does not necessarily include the holding portion or the connecting portion. The sheet separating device may be simply placed on the placement portion in use. That is, it is sufficient that the sheet separating device according to the exemplary embodiments of the present invention include the sheet separator having the separating portions and the openings described in the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet separating device comprising:

a sheet separator that includes a plurality of separating portions which have a planar shape and which are stacked one on top of another, that has openings provided between the plurality of separating portions at both ends of the plurality of separating portions in a sheet passing direction, and that allows gaps between the plurality of separating portions facing one another to receive one of a plurality of sheets apiece so as to cause the plurality of sheets to be kept separated from one another, wherein one of the openings at one of the ends of the plurality of separating portions is opposite a corresponding one of the openings at another one of the ends of the plurality of separating portions; and coupling portions that are disposed between the plurality of separating portions on both sides of the plurality of separating portions in a sheet width direction intersecting the sheet passing direction and configured to receive the plurality of sheets having the same width and that connect the plurality of separating portions to one another in a stacking direction in which the plurality of separating portions are stacked, wherein the sheet separating device is held on a placement portion of a sheet processing apparatus that includes a sheet processing unit which sequentially feeds thereinto the plurality of sheets through the openings at both ends of the plurality of separating portions and a feeding opening and which performs processing on the plurality of sheets and the placement portion on which the plurality of sheets to be fed through the feeding opening are placed, wherein the coupling portions connect the plurality of separating portions such that a closed state in which the plurality of separating portions adjacent to each other are in contact with each other and an open state in which the plurality of separating portions adjacent to each other are spaced from each other are switchable to each other.

2. The sheet separating device according to claim 1, further comprising:

a holding portion that is secured to a lowermost separating portion out of the plurality of separating portions and that is held on the placement portion.

3. The sheet separating device according to claim 1, wherein the coupling portions have a bellows shape.

4. The sheet separating device according to claim 1, further comprising:

a connecting portion that connects an uppermost separating portion out of the plurality of separating portions and the sheet processing apparatus to each other so as to maintain the open state.

5. The sheet separating device according to claim 1, wherein, out of the plurality of separating portions, separating portions other than at least an uppermost separating portion and a lowermost separating portion are formed of a flexible material.

6. The sheet separating device according to claim 1, wherein, in the closed state, an uppermost separating portion out of the plurality of separating portions functions as, together with the placement portion, a table on which the plurality of sheets fed through the feeding opening are placed.

7. The sheet separating device according to claim 1, further comprising:

a support portion that supports the sheet separator on an upper side and a lower side of the placement portion such that the sheet separator is able to be moved from the lower side to the upper side of the placement portion or vice versa.

8. The sheet separating device according to claim 1, further comprising:

a sheet holding portion that holds in a folded state the plurality of sheets which are inserted into the gaps between the plurality of separating portions and portions of which existing beyond portions of the plurality of separating portions far from the feeding opening are folded on an uppermost separating portion out of the plurality of separating portions and that guides the plurality of sheets when the plurality of sheets are fed through the feeding opening.

9. The sheet separating device according to claim 1, further comprising:

a sheet regulating portion that is inserted into the plurality of separating portions in a stacking direction in which the plurality of separating portions are stacked and that regulates a position of the plurality of sheets in a width direction.

10. The sheet separating device according to claim 1, wherein the sheet processing apparatus is an image forming apparatus that forms images on the plurality of sheets fed through the feeding opening.

11. An image forming apparatus comprising:

a sheet separator that includes a plurality of separating portions which have a planar shape and which are stacked one on top of another, that has openings provided between the plurality of separating portions at both ends of the plurality of separating portions in a sheet passing direction, and that allows gaps between the plurality of separating portions facing one another to receive one of a plurality of sheets apiece so as to cause the plurality of sheets to be kept separated from one another, wherein one of the openings at one of the ends of the plurality of separating portions is opposite a corresponding one of the openings at another one of the ends of the plurality of separating portions;

coupling portions that are disposed between the plurality of separating portions on both sides of the plurality of separating portions in a sheet width direction intersecting the sheet passing direction and configured to receive the plurality of sheets having the same width and that connect the plurality of separating portions to one another in a stacking direction in which the plurality of separating portions are stacked, wherein the coupling portions connect the plurality of separating portions such that a closed state in which the plurality of separating portions adjacent to each other are in contact with each other and an open state in which the plurality of separating portions adjacent to each other are spaced from each other are switchable to each other;

an image forming unit that forms images on the plurality of sheets fed thereinto through the openings at both ends of the plurality of separating portions, a feeding opening which allows the plurality of sheets supported by the sheet separator to be fed therethrough, a placement portion which the sheet separating device is held on the placement portion, and a sheet processing unit which sequentially feeds thereinto the plurality of sheets through the openings at both ends of the plurality of separating portions.

* * * * *